US006554655B2

(12) United States Patent
Chadbourne

(10) Patent No.: US 6,554,655 B2
(45) Date of Patent: Apr. 29, 2003

(54) MODULAR LUG BLOCK ASSEMBLY

(75) Inventor: Richard Chadbourne, Merrimack, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/981,310

(22) Filed: Oct. 16, 2001

(65) Prior Publication Data

US 2003/0003811 A1 Jan. 2, 2003

Related U.S. Application Data

(63) Continuation-in-part of application No. 09/892,901, filed on Jun. 27, 2001.

(51) Int. Cl.[7] ..... H01R 9/22
(52) U.S. Cl. ..... 439/718; 439/791
(58) Field of Search ..... 439/718, 797, 439/721, 801; 174/65 R, 59; 248/59

(56) References Cited

U.S. PATENT DOCUMENTS 2,431,999 A * 12/1947 Engelhardt ..... 339/328
2,892,176 A * 6/1959 Gordon ..... 339/198
4,050,770 A * 9/1977 Rigo ..... 339/198
5,586,905 A * 12/1996 Marshall et al. ..... 439/463
5,632,647 A * 5/1997 Dobbin et al. ..... 439/521

* cited by examiner

*Primary Examiner*—P. Austin Bradley
*Assistant Examiner*—Alexander Gilman
(74) *Attorney, Agent, or Firm*—Harrington & Smith, LLP

(57) ABSTRACT

An electrical power connection block housing including a first housing piece and a second housing piece. The first housing piece forms at least a portion of a first exterior side of the block housing. An interior side of the first housing piece has a first slot shaped bus bar mounting area. The second housing piece is connected to the first housing piece. The second housing piece has a portion with a first side located directly opposite the interior side of the first housing piece and a second slot shaped bus bar mounting area on the first side of the second housing piece. The first and second housing pieces form a first bus bar receiving area with the first and second bus bar mounting areas located generally opposite each other on opposite sides of the receiving area for capturing a bus bar therebetween.

3 Claims, 13 Drawing Sheets

MODULAR LUG BLOCK ASSEMBLY

CROSS-REFERENCE TO RELATED APPLICATION

This is a continuation-in-part of copending application Ser. No. 09/892,901 filed Jun. 27, 2001 which is herby incorporated by reference in its entirety.

BACKGROUND OF THE INVENTION

1. Field of the Invention

The present invention relates to electrical connectors and, more particularly, to an electrical connection block assembly.

2. Brief Description of Prior Developments

Power stud blocks are generally known in the art. For example, Marathon Special Products sells 600 Volt power stud blocks under the catalog numbers 1422122 and 1423122. Power stud blocks are generally used for AC or DC power distribution, such as for a DC circuit in a telecom application. Power stud blocks can be provided in two pole or three poll configurations.

There is a desire to provide an electrical power connection block which is smaller in size than conventional electrical power connection blocks. There is also a desire to provide an electrical power connection block which has modular components to allow multiple different types of connection blocks to be manufactured with use of common components.

SUMMARY OF THE INVENTION

An electrical power connection block housing comprising a container and a cover. The container comprises multiple housing pieces connected to form at least two electrical connector receiving areas. Each connector receiving area has end apertures through opposite ends of the container at joints between the housing pieces. A first one of the connector receiving areas comprises two of the end apertures in a first one of the opposite ends and one of the end apertures in a second one of the opposite ends.

An electrical power connection block housing comprising a container and a cover connected to a top side of the container. The container comprises multiple housing pieces connected to form at least two connector receiving areas. The container has a first conductor pass-through aperture in an end wall open to a top open side of the container. The has a downwardly extending end side with a second conductor pass-through aperture aligned with the first conductor pass-through aperture. The end side of the cover has slits extending outward from the second conductor pass-through aperture forming cantilevered deflectable fingers extending up to the second conductor pass-through aperture.

An electrical power connector block housing comprising a first housing piece having a first interlock connection section; and a second housing piece having a first side with a second interlock connection section directly interconnected with the first interlock connection section and forming an electrical connector receiving area therebetween with conductor pass-through apertures at end joints between the first and second housing pieces at the end walls of the first and second housing pieces.

The first and second interlock connection sections comprise mating projections and recesses. Leading edges of at least some of the projections of the second housing piece comprise a non-vertical surface located opposite a matching non-vertical surface in one of the recesses of the first housing piece such that a distance along a projection and recess joint between the non-vertical surfaces is longer than a height of the projection and recess joint.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
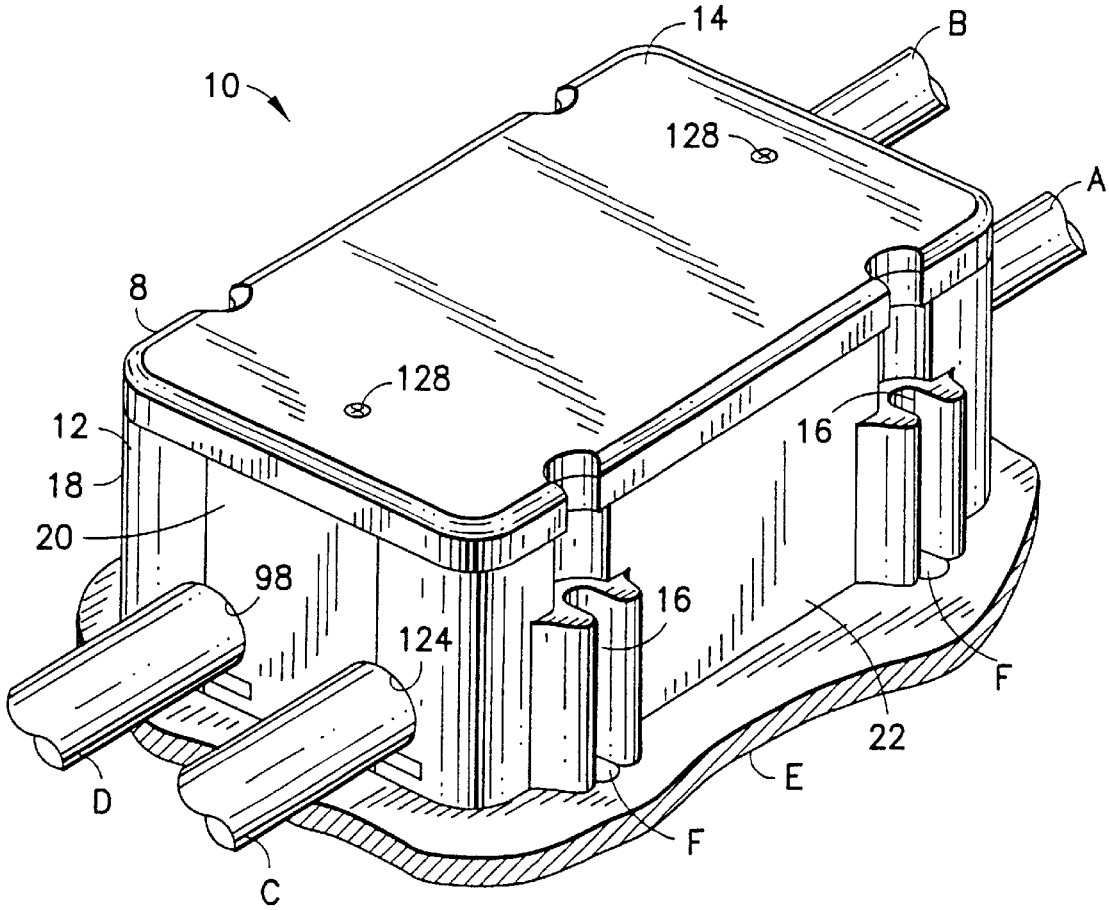
FIG. 1 is a top, front and right side perspective view of an electrical connection block assembly shown connected to electrical conductors and located on another member.

Referring to FIG. 1, there is shown a perspective view of an electrical power connection block assembly 10 shown attached to electrical conductors A, B, C and D and located on top of a mounting member E. Although the present invention will be described with reference to the embodiments shown in the drawings, it should be understood that the present invention can be embodied in many alternate forms of embodiments. In addition, any suitable size, shape or type of elements or materials could be used.

Figure 3:
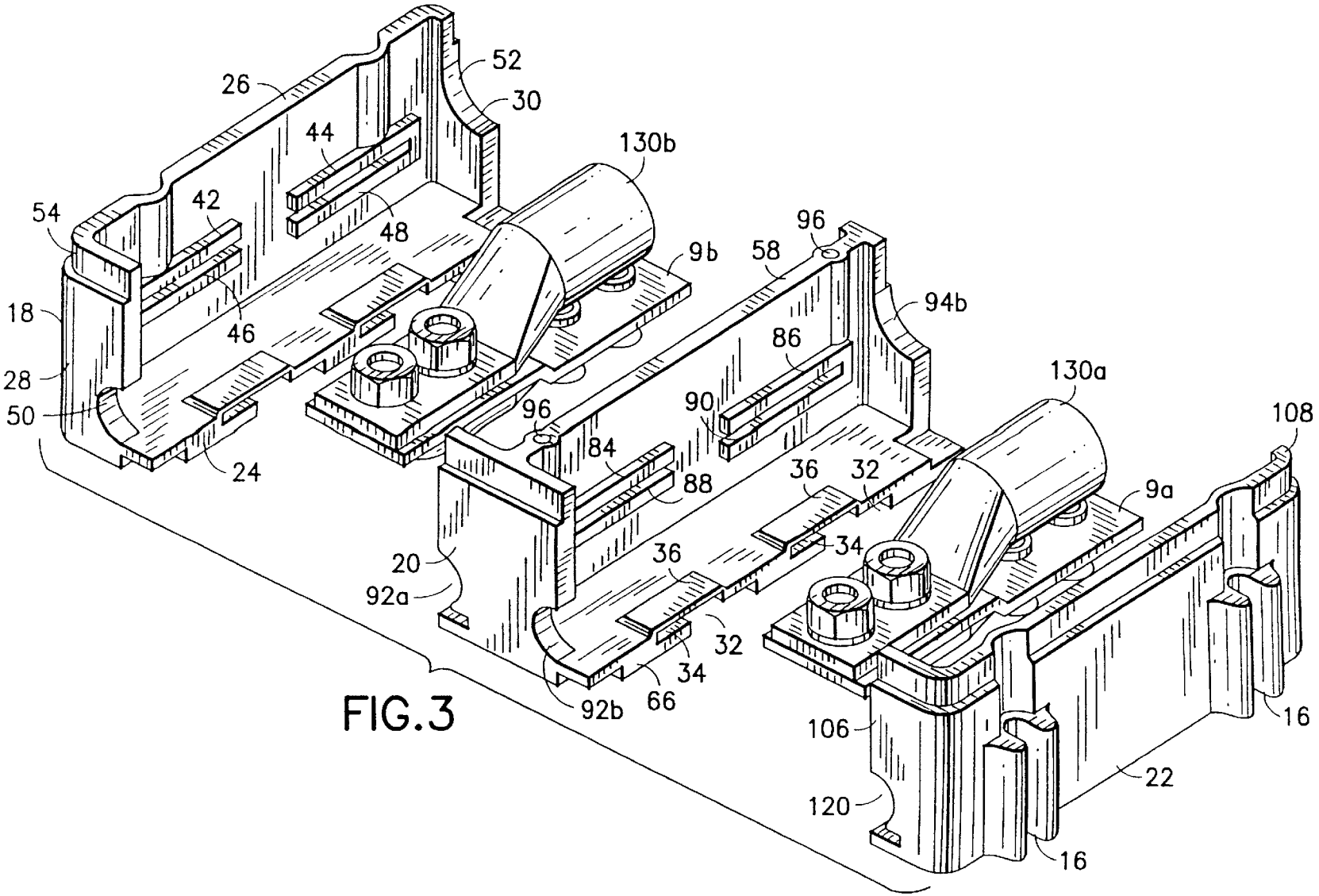
FIG. 3 is an exploded perspective view of some of the components of the assembly shown in FIG. 2.

The block assembly 10 generally comprises a housing 8 and electrical bus bars 9*a*, 9*b* (see FIG. 3; also referred to as bus bars 9). The housing 8 generally comprises a container 12 and a cover 14. However, in an alternate embodiment, the cover might not be provided. In the embodiment shown, the block assembly 10 is a two pole block assembly. However, as described below, features of the present invention can be incorporated into a three or more poll block assembly. In the embodiment shown, the block assembly 10 is for a DC power distribution circuit. However, in an alternate embodiment, the present invention could be used as an AC power distribution circuit.

Conductors A and C are connected to each other inside the block assembly 10 by bus bar 9*a* and are connected to supply electricity from a battery. Conductors B and D are connected to each other inside the block assembly 10 by bus bar 9*b* and are connected as a return to the battery. However, the conductors A–D could be connected to any suitable components. In addition, more or less than four conductors could be connected by the block assembly.

The mounting member E could be any suitable type of component, such as a metal sheet member. The mounting member E comprises holes F therethrough. Fasteners (not shown) such as screws can be used to fixedly attach the block assembly 10 to the mounting member E by being screwed into the holes F and being located in the fastener receiving areas 16 of the container 12. However, In alternate embodiments, any suitable type of system for mounting the block assembly 10 to another component could be provided.

Referring also to FIGS. 2–7, the container 12 generally comprises three housing pieces 18, 20 and 22. However, in alternate embodiments, the container 12 could be comprised of more or less than three housing pieces. The first and third housing pieces 18, 22 are substantially mirror images of each other except at their bottom sections as will be described in further detail below. The first and third housing pieces 18, 22 form the outer sides of the container 12. The first housing piece 18 forms a left side. The third housing piece 22 forms a right side. The terms "right", "left", "top", "bottom", "front" and "rear" are used herein for reference only. The second housing piece 20 is sandwiched between the first and third housing pieces. Thus, the second housing piece 20 forms a middle piece of the container 12.

The first housing piece 18 generally comprises a bottom section 24, a side section 26, a front section 28 and a rear section 30. The bottom section 24 comprises a first interlock connection section 25. As seen best in FIG. 6, the first interlock connection section 25 comprises a side edge of the bottom section 24 having two pairs of bottom slots 32, top slots 34, and cover sections 36. However, more or less than two pairs could be provided. In addition, the first interlock connection section could have any suitable type of size or shape. For example, rather than molding the cover section 36 over the top slot, a piece of non-integrally-molded flat insulating material can be placed over the top slot.

In the embodiment shown, the top slots 34 are located over the bottom slots 32. The bottom slots 32 extend into the side edge a further distance than the top slots 34. The top and bottom slots are connected to each other, but the top and bottom slots or partially horizontally offset from each other in each pair. The cover sections 36 are located over the top slots 34. In an alternate embodiment the cover sections 36 might not be provided. Front and rear ends of the bottom section 24 also comprise slots 38, 40.

The side section 26 has an interior facing side which comprises a bus bar mounting area. In the embodiment shown, the bus bar mounting area generally comprises a first projection 42 and a second projection 44. The first projection 42 has a general C shape and extends inward from the interior side. The second projection has a general reversed C shape and extends inward from the interior side. In the embodiment shown, the first and second projections are partially vertically offset from each other.

The C shape and reversed C shape each form a slot 46, 48 which are vertically offset from each other. The slots 46, 48 form receiving areas for one of the side edges of one of the bus bars 9*a*, 9*b* as will be described in further detail below. In alternate embodiments, the bus bar mounting areas could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. An exterior side of the first housing piece 18 at the side section 26 comprises the fastener mounting areas 16. The front section 28 comprises a recess 50. The rear section 30 comprises a recess 52. The top side of the side section 26, front section 28 and rear section 30 form part of a cover mounting lip 54 (see FIGS. 2 and 4).

Figure 5:
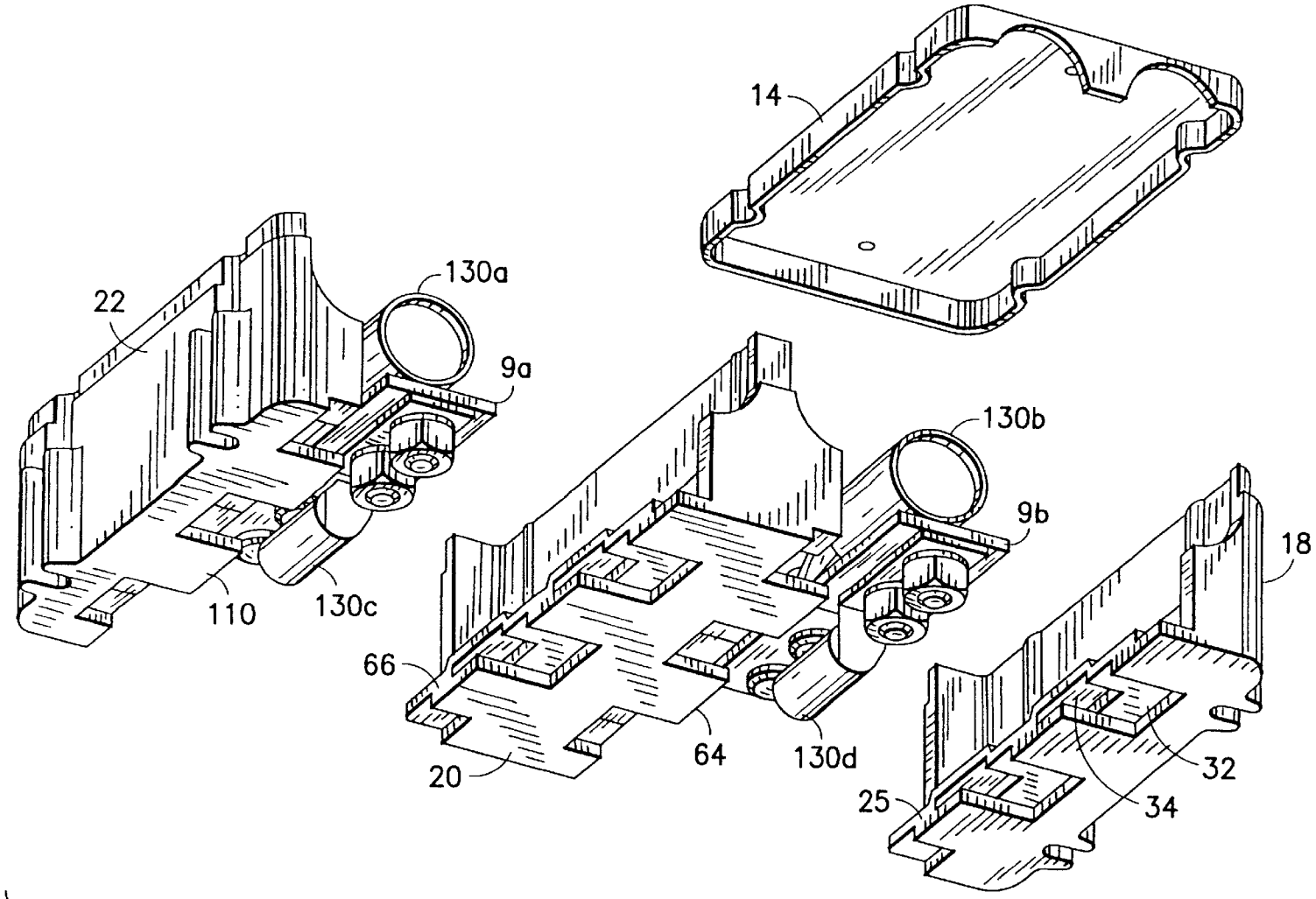
FIG. 5 is an exploded bottom, rear and right side perspective view of the components of the assembly shown in FIG. 2.
Figure 6:
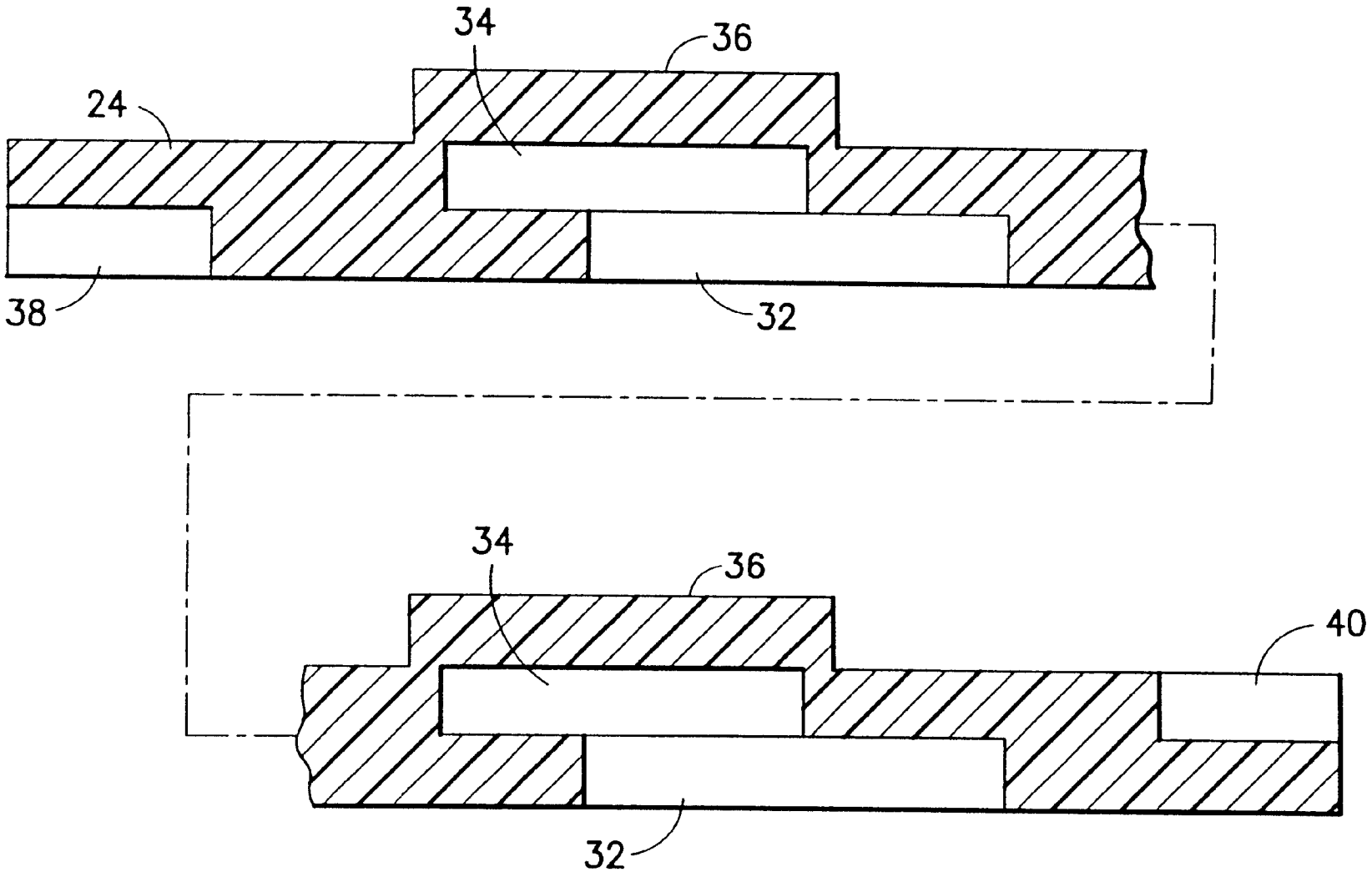
FIG. 6 is a cross sectional view of the first interlock connection section of the first housing piece.
Figure 7:
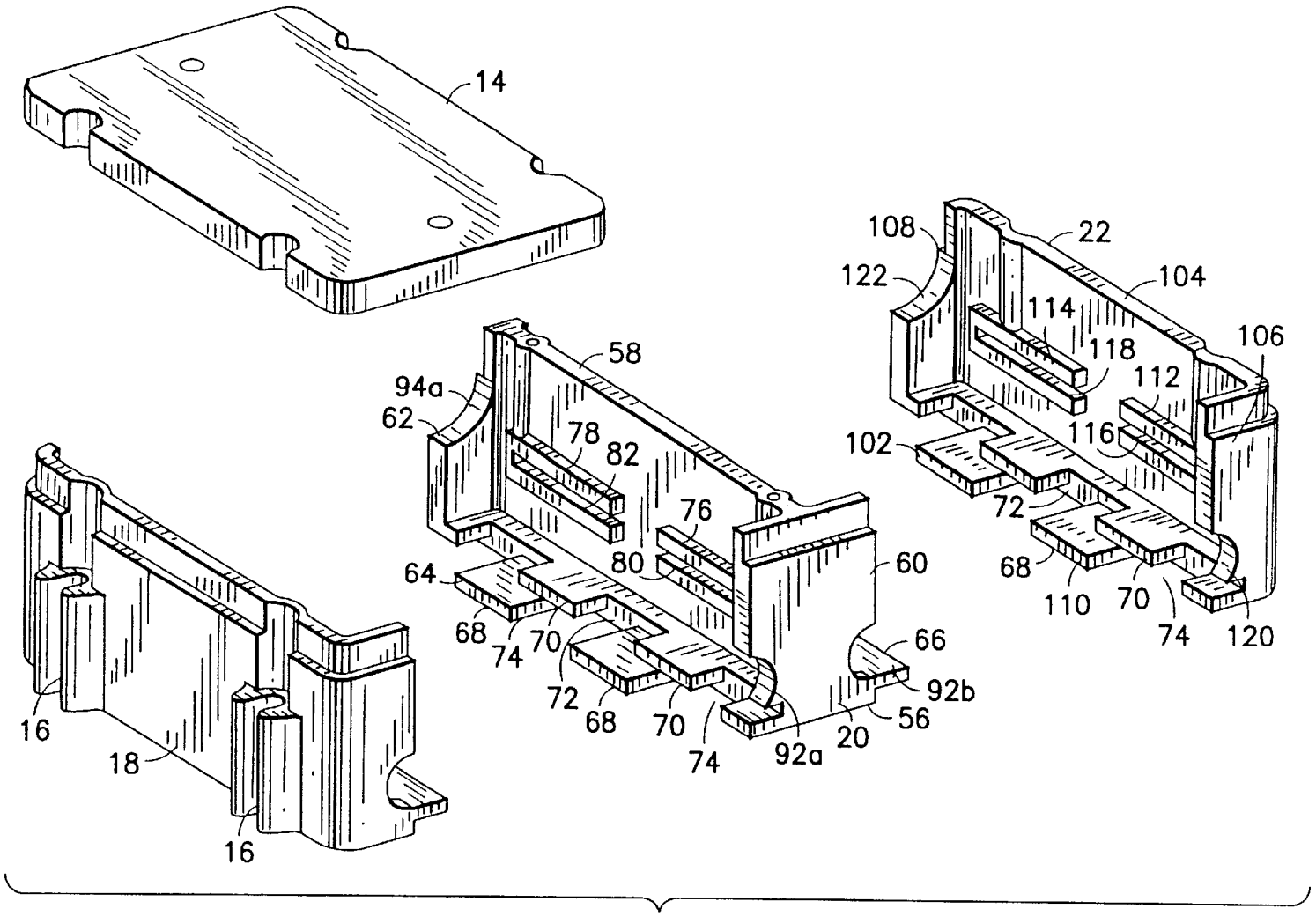
FIG. 7 is an exploded top, left side and front side perspective view of the housing.

As best seen in FIGS. 3, 5 and 7, the second housing piece 20 generally comprises a bottom section 56, a middle section 58, a front section 60 and a rear section 62. The bottom section 56 comprises a second interlock connection section 64 and a third interlock connection section 66. The third interlock connection section 66 is substantially identical to the first interlock connection section 25. However, in alternate embodiments, the first and third interlock connection sections could have different sizes or shapes. As seen best in FIG. 3, the third interlock connection section 66 comprises a side edge of the bottom section 56 having two pairs of bottom slots 32, top slots 34, and cover sections 36. However, more or less than two pairs could be provided. In addition, the third interlock connection section could have any suitable type of size or shape.

The second interlock connection section 64 comprises a side edge of the bottom section 56 having two pairs of bottom projections 68, top projections 70 and, recesses 72, 74 between the pairs. However, more or less than two pairs could be provided. In addition, the second interlock connection section could have any suitable type of size or shape. In the embodiment shown, the top projections 70 are located over the bottom projections 68. The bottom projections 68 extend outward at the side edge a further distance than the top projections 70. The top and bottom projections are partially horizontally offset from each other in each pair. The second interlock connection section 64 is sized and shaped to mate with the first interlock connection section 25.

The middle section 58 has a side which faces the first housing piece 18 which comprises a bus bar mounting area. In the embodiment shown, the bus bar mounting area generally comprises a first projection 76 and a second projection 78. The first projection 76 has a reversed general C shape and extends from the side. The second projection has a general C shape and extending from the side. In the embodiment shown, the first and second projections are partially vertically offset from each other. The C shape and reversed C shape form slots 80, 82 which are vertically offset from each other. The slots 80, 82 form receiving areas for one of the side edges of one of the bus bars 9 as will be described in further detail below.

As seen best in FIG. 3, the middle section 58 also has an opposite side which comprises a bus bar mounting area and which faces the third housing piece 22. In the embodiment shown, the bus bar mounting area on the opposite side generally comprises a first projection 84 and a second projection 86. The first projection 84 has a general C shape and extends outward from the side. The second projection has a general reversed C shape and extends outward from the side. In the embodiment shown, the first and second projections are partially vertically offset from each other.

The C shape and reversed C shape each form a slot 88, 90 which are vertically offset from each other. The slots 88, 90 form receiving areas for one of the side edges of one of the bus bars 9 as will be described in further detail below. In alternate embodiments, the bus bar mounting areas could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. The lateral sides of the front and rear ends of the bottom section 56 also comprises slots and projections.

The front section 60 comprises two recesses 92*a*, 92*b*. The rear section 62 comprises two recesses 94*a*, 94*b*. The top side of the front section 60 and rear section 62 form part of the cover mounting lip 54. The middle section 58 has fastener holes 96 into its top side. As seen with reference to FIGS. 1 and 2, when the second housing piece 20 is connected to the first housing piece 18, the recesses 50 and 92*a* form an aperture 98 which allows the conductor D to pass through the housing 8. Likewise, the recesses 52 and 94*a* form an aperture 100 which allows the conductor B to pass through the housing 8.

The third housing piece 22 generally comprises a bottom section 102, a side section 104, a front section 106 and a rear section 108. The bottom section 102 comprises a fourth interlock connection section 110. The fourth interlock connection section 110 is substantially identical to the second interlock connection section 64. However, in alternate embodiments, the second and fourth interlock connection sections could have different sizes and shapes.

As seen best in FIG. 7, the fourth interlock connection section comprises a side edge of the bottom section 102 having two pairs of bottom projections 68, top projections 70 and, recesses 72, 74 between the pairs. However, more or less than two pairs could be provided. In addition, the fourth interlock connection section could have any suitable type of size or shape. In the embodiment shown, the top projections 70 are located over the bottom projections 68. The bottom projections 68 extend outward at the side edge a further distance than the top projections 70. The top and bottom projections are partially horizontally offset from each other in each pair. The fourth interlock connection section 110 is sized and shaped to mate with the third interlock connection section 66.

The side section 104 has an interior facing side which comprises a bus bar mounting area. The bus bar mounting area on the side section 104 is substantially identical to the bus bar mounting area on the side of the middle section 58 of the middle housing piece 20 which faces the first housing piece 18. However, in alternate embodiments, the two bus bar mounting areas could have different sizes and shapes.

In the embodiment shown, the bus bar mounting area in the side section 104 generally comprises a first projection 112 and a second projection 114. The first projection 112 has a general C shape and extends inward from the interior side. The second projection 114 has a general reversed C shape and extends inward from the interior side. In the embodiment shown, the first and second projections are partially vertically offset from each other. The C shape and reversed C shape each form a slot 116, 118 which are vertically offset from each other. The slots 116, 118 form receiving areas for one of the side edges of one of the bus bars 9 as will be described in further detail below.

In alternate embodiments, the bus bar mounting area on the side section 104 could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. An exterior side of the third housing piece 22 at the side section 104 comprises the fastener mounting areas 16. The front section 106 comprises a recess 120. The rear section 108 comprises a recess 122. The top side of the side section 104, front section 106 and rear section 108 form part of the cover mounting lip 54. As seen with reference to FIGS. 1 and 2, when the second housing piece 20 is connected to the third housing piece 22, the recesses 92*b* and 120 form an aperture 124 which allows the conductor C to pass through the housing 8. Likewise, the recesses 94*b* and 122 form an aperture 126 which allows the conductor A to pass through the housing 8.

Figure 2:
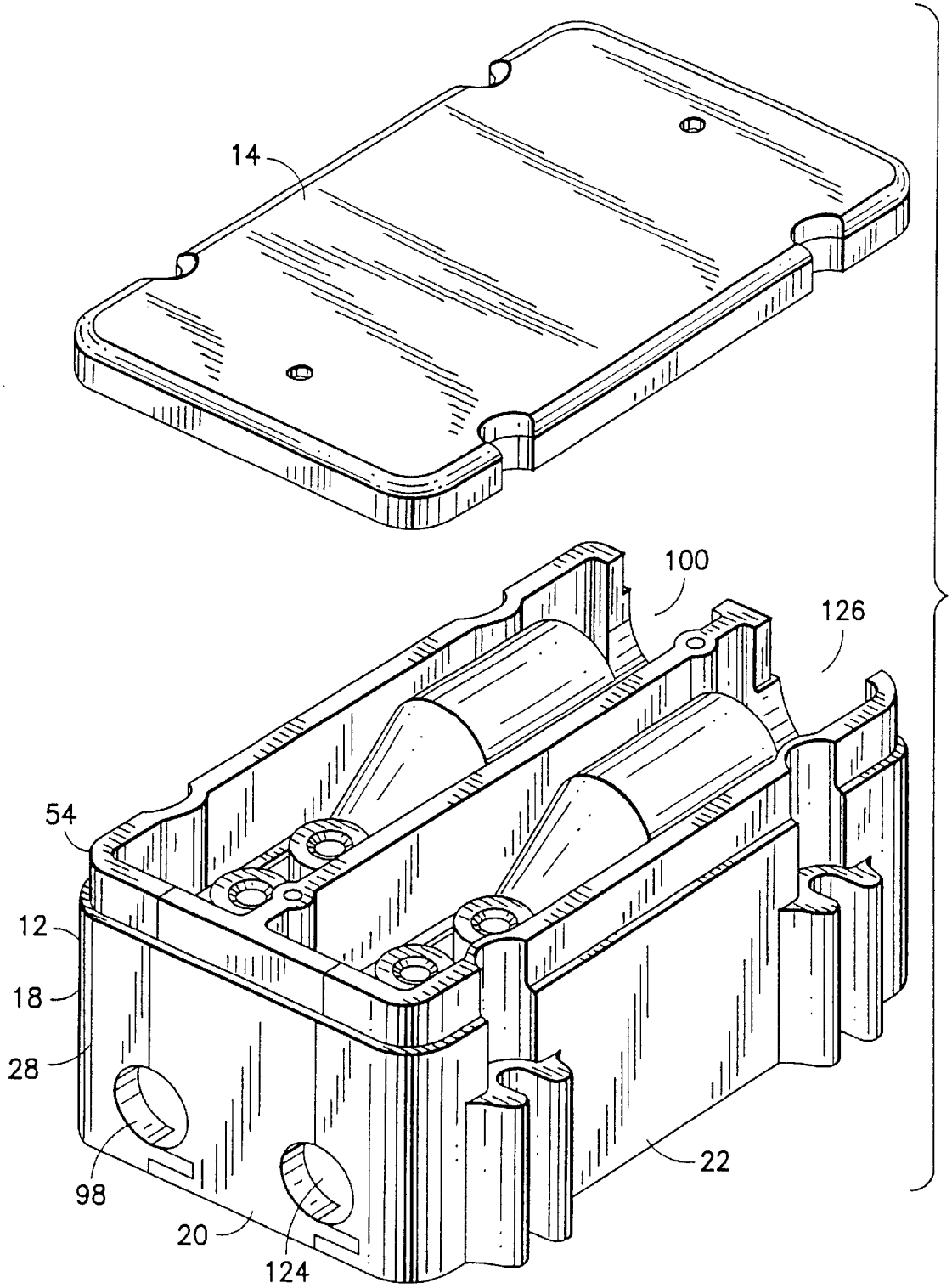
FIG. 2 is a top, front and right side perspective view of the assembly shown in FIG. 1 without the electrical conductors and with the cover located in an exploded position.
Figure 4:
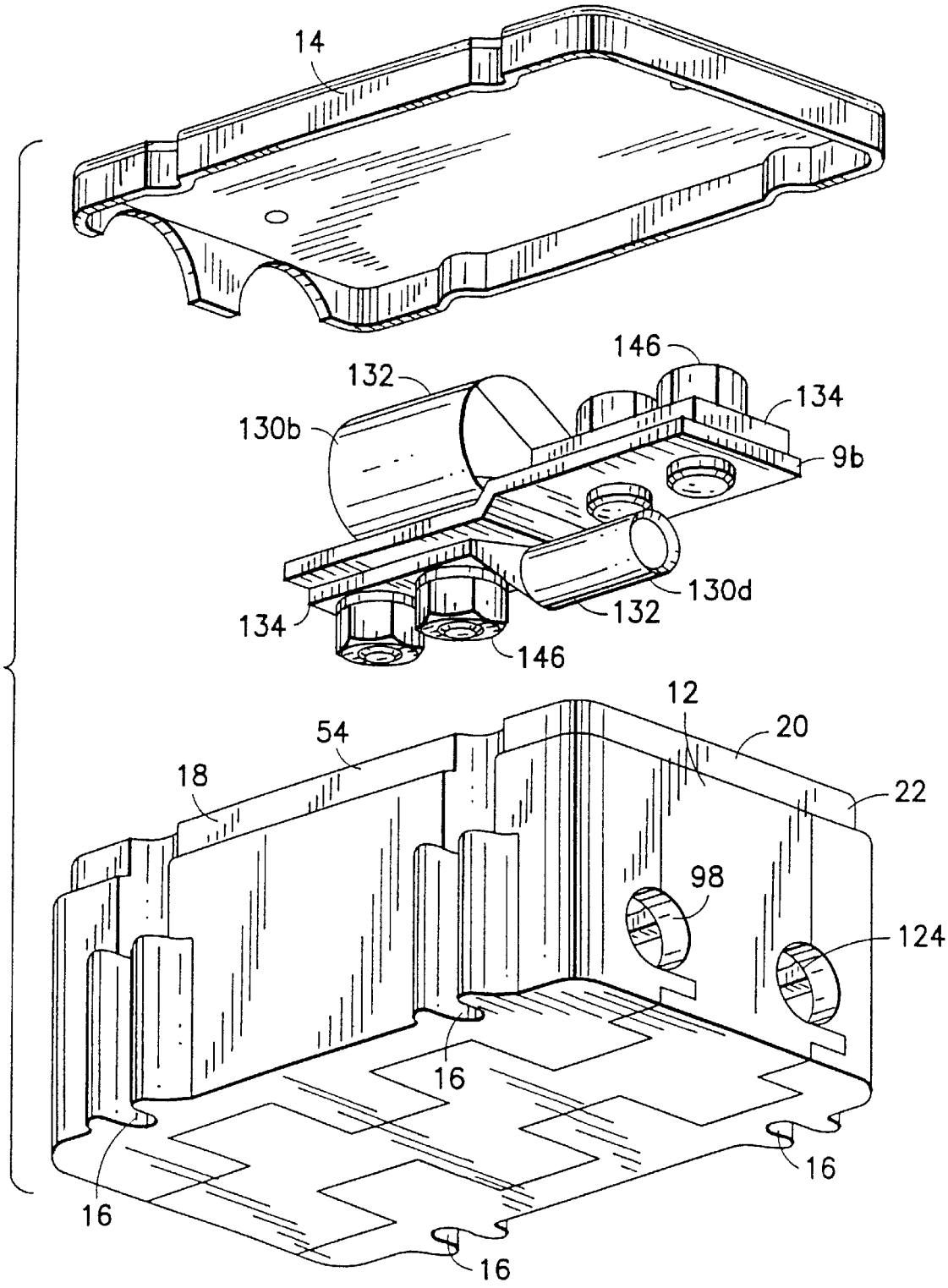
FIG. 4 is an exploded bottom, front and left side perspective view of some of the components of the assembly shown in FIG. 2.

The housing pieces 18, 20 and 22 are adapted to be assembled to each other as shown in FIGS. 1, 2 and 4. The first interlock connection section 25 and the second interlock connection section 64 matingly interlock with each other. Likewise, the third interlock connection section 66 and the fourth interlock connection section 110 matingly interlock with each other. This forms the container 12. The cover 14 can be placed on the container lip 54 and fasteners 128 (see FIG. 1) can fixedly attach the cover 14 to the center section 58 of the middle piece 20. However, the cover 14 might not be provided. The housing pieces 18, 20 and 22 are preferably retained with each other by fasteners (not shown) located in the fastener receiving areas 16 and attached to the member E. However, in alternate embodiments, any suitable means could be provided for fixedly retaining the housing pieces with each other separate from the member E, such as the cover 14 for example.

Before the housing pieces 18, 20 and 22 are attached to the member E, the conductors A–D or preferably attached to connectors 130*a*–130*d* which, in turn, are fixedly attached to the bus bars 9. The connectors 130*a*–130*d* generally comprise a first section 132 and a second section 134. The first section 132 is adapted to be crimped or compressed onto one of the conductors A–D. The second section 134 as holes therethrough for mounting on posts of the bus bars 9. However, in alternate embodiments, the block assembly 10 could be used with conductors having any suitable type or shape of connectors thereon.

Figure 8:
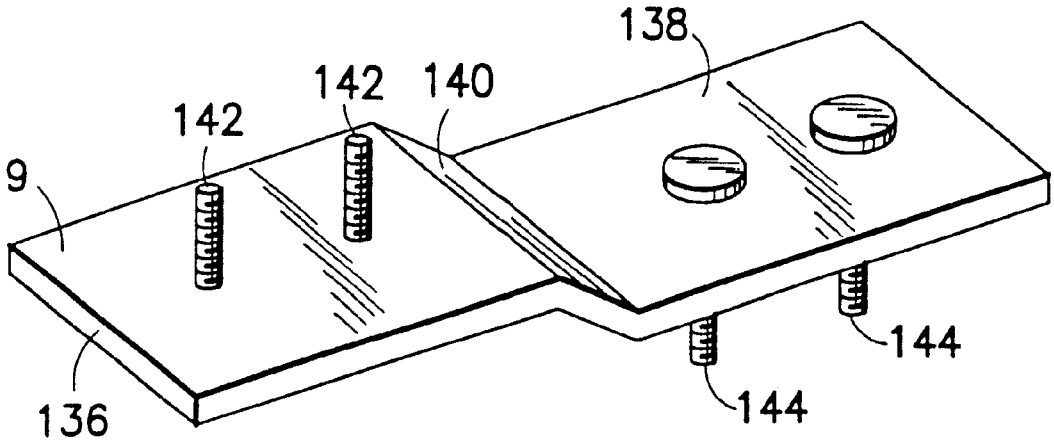
FIG. 8 is a perspective view of one of the bus bars used in the assembly shown in FIG. 2.

Referring also to FIG. 8, each bus bar 9 generally comprises a first section 136, a second section 138, and a connecting section 140. In alternate embodiments, the bus bars could be different from each other. The first section 136 comprises fastening posts 142. The second section 138 comprises fastening posts 144. The fastening posts 142 extend in an opposite direction from the fastening posts 144. Although the embodiment shown shows two fastening posts for each of the first and second sections 136, 138, each section might comprise more or less than two fastening posts. In addition, rather than fastening posts, the bus bar could comprise any suitable means for fixedly and stationarily attaching the connectors 130 thereto.

Figure 10:
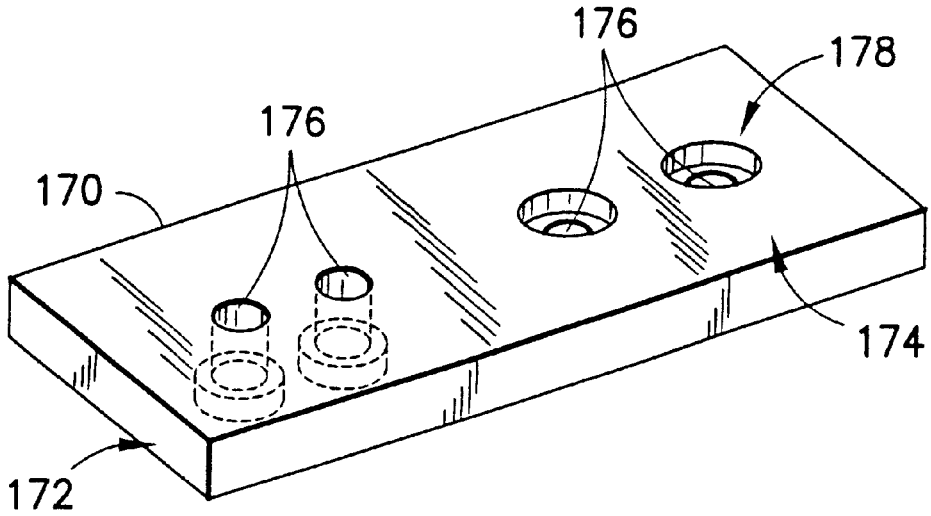
FIG. 10 is a perspective view of an alternate embodiment of the bus bar shown in FIG. 8.
Figure 11:
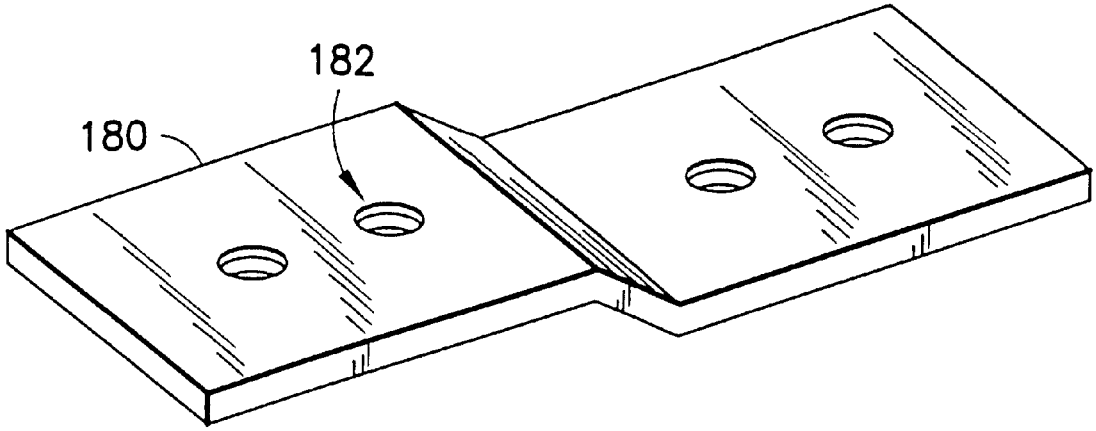
FIG. 11 is a perspective view of another alternate embodiment of the bus bar shown in FIG. 8.
Figure 12:
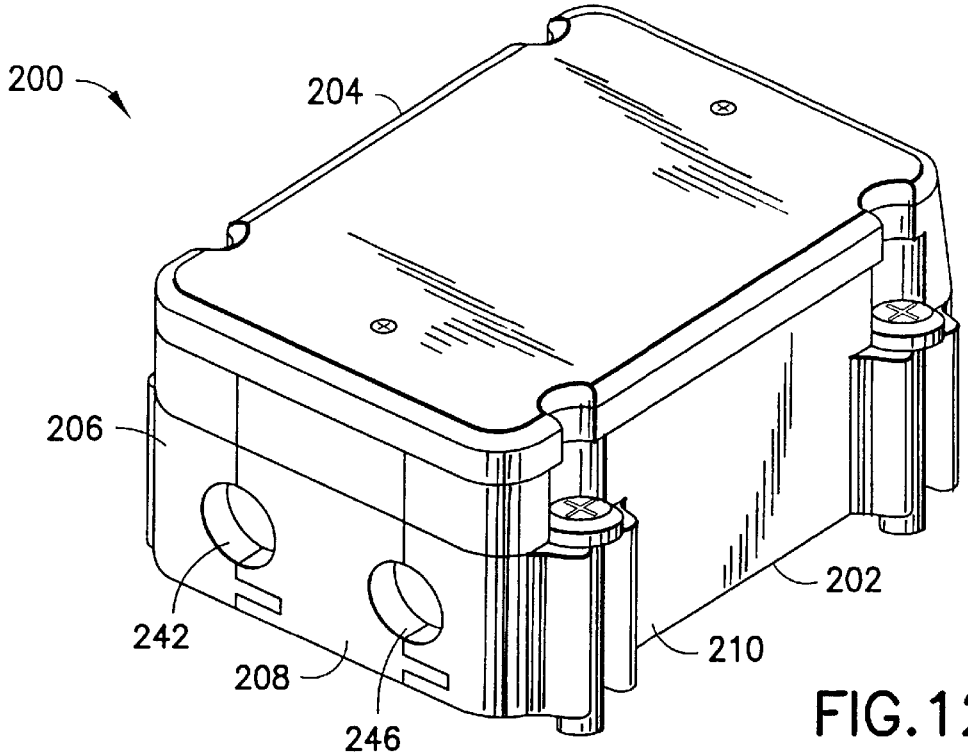
FIG. 12 is a perspective view of another alternate embodiment of the electrical power connection block housing incorporating features of the present invention.
Figure 13:
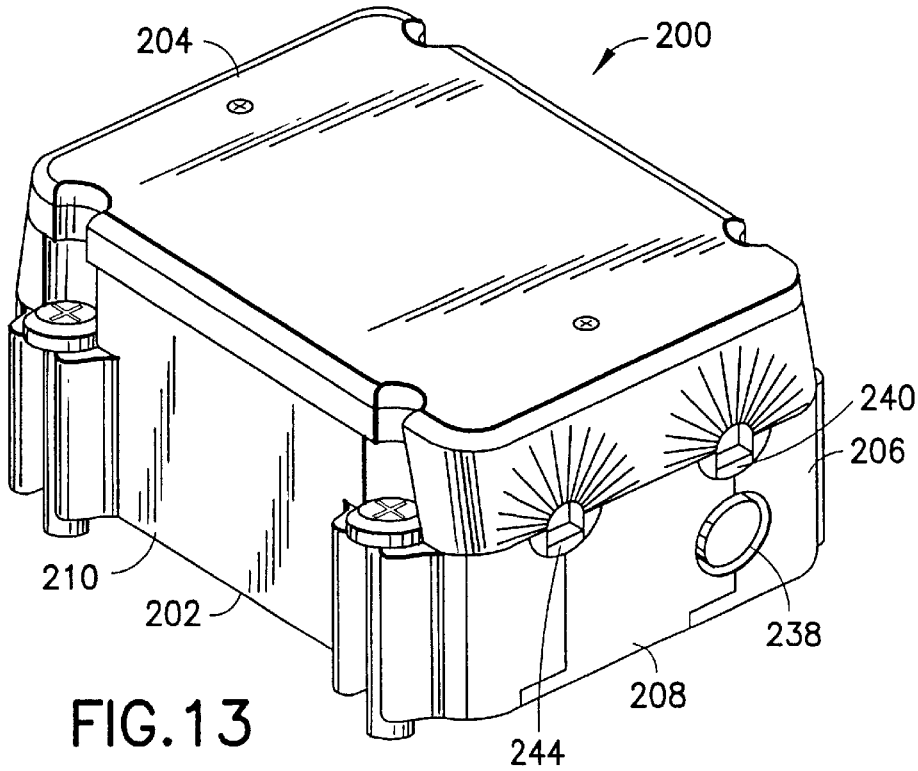
FIG. 13 is a perspective view of the opposite end of the block housing shown in FIG. 12.

One alternate embodiment of the bus bar is shown in FIG. 10. In this alternate embodiment, the bus bar 170 comprises a flat block of stock material with two sets 172, 174 of fastener mounting holes 176. The fastener holes have enlarged counter-bored sections 178 which are adapted to receive a head of a fastener, such as a stud or screw, for clearance. Each set 172, 174 has its counter-bored sections 178 on opposite sides of the bus bar. Another alternate embodiment of the bus bar is shown in FIG. 11. In this embodiment the bus bar 180 has tapped or threaded holes 182. This allows the use of screws or bolts instead of nuts on studs.

In the embodiment shown, the first section 136 is vertically offset from the second section 138. The connecting section 140 connects the first section 136 with the second section 138. In this embodiment, the first section 136, second section 138 and connecting section 140 form a general Z shape. However, in alternate embodiments, the sections could form the bus bar in any suitable type of shape. For example, the first and second sections 136, 138 might not be vertically offset from each other. The first and second sections could have notches on their respective top and bottom sides. Alternatively, the first and second sections could have raised sections on their respective top and bottom sides for receiving the second sections 134. For such alternatives embodiments, the slots in each of the bus bar mounting areas might not be vertically offset from each other.

The second sections 134 of the connectors 130 are mounted on the posts 142, 144 and the nuts 146 are attached to the posts 142, 144 to fixedly and stationarily attach the connectors 130 to the bus bars 9. As seen best in FIGS. 4 and 5, the connectors 130*a* and 130*b* are located on top sides of the bus bars 9 and extend towards the rear ends of the bus bars. The connectors 130*c* and 130*d* are located on bottom sides of the bus bars 9 and extend towards the front ends of the bus bars. These connections could be made in a factory the housing pieces being mounted on the piece of equipment E with screws in cavities 16. Conductors A and B could be installed during equipment installation when the electrical power is connected.

With the conductors A–D attached to the connectors 130, and the connectors 130 attached to the bus bars 9*a*, 9*b*, the bus bars 9 are placed between the housing pieces 18, 20 and 22. The housing pieces 18, 20 and 22 are then assembled to each other. During assembly, side edges of the bus bars 9 are received in the slots of the bus bar mounting areas in the housing pieces. The two slots 46 and 80 are located directly opposite each other. The two slots 48 and 82 are located directly opposite each other. The two slots 88 and 116 are located directly opposite each other. The two slots 90 and 188 are located directly opposite each other.

A right side edge of the right bus bar 9*a* is located in the bus bar receiving area of the third housing piece 22. More specifically, the right side edge of the first section 136 is located in the slot 116, the right side edge of the second section 138 is located in the slot 118, and the right side edge of the connecting section 140 is located between the two projections 112, 114. A left side edge of the bus bar 9*a* is located in the right side bus bar receiving area of the second housing piece 20. More specifically, the left side edge of the first section 136 is located in the slot 88, the left side edge of the second section 138 is located in the slot 90, and the left side edge of the connecting section 140 is located between the two projections 84, 86. This stationarily traps the bus bar 9*a* between the housing pieces 20, 22 at a predetermined fixed location. The top and bottom sides of the bus bar 9*a* and connectors 130*a*, 130*c* are spaced a predetermined distance from the top and bottom sides of the housing 8 to provide a predetermined air clearance.

A left side edge of the left bus bar 9*b* is located in the bus bar receiving area of the first housing piece 18. More specifically, the left side edge of the first section 136 is located in the slot 46, the left side edge of the second section 138 is located in the slot 48, and the left side edge of the connecting section 140 is located between the two projections 42, 44. A right side edge of the bus bar 9*b* is located in the left side bus bar receiving area of the second housing piece 20. More specifically, the right side edge of the first section 136 is located in the slot 80, the right side edge of the second section 138 is located in the slot 82, and the right side edge of the connecting section 140 is located between the two projections 76, 78. This stationarily traps the bus bar 9*b* between the housing pieces 18, 20 at a predetermined fixed location. More specifically, the top and bottom sides of the bus bar 9*b* and connectors 130*b*, 130*d* are spaced a predetermined distance from the top and bottom sides of the housing 8 to provide a predetermined air clearance. The top connectors 130*a*, 130*b* can also be removed from the bus bars 9 without removing the bus bars from their connection with the housing pieces 18, 20, 22.

One of the features of the present invention is the use of both lateral sides of the bus bars to mount and entrap the bus bars between the housing pieces. Entrapping the bus bars in a suspended matter enables both sides of the bus bar to be used. This results in a much smaller electrical power connection block. This can take up less space on the member E. This invention can allow a method of making a factory connection at an OEM that enables the end user to make the power connection with a reliable lug terminal. The two pole lug block body described above consists of merely three molded plastic component housing pieces that interlock with each other trapping the two bus bars suspended in between them. The present invention uses the lateral sides of the bus bars as mounting ears for the bus bars. This can reduce the overall size of the connection block. If a three poll installation is required, then an additional center block 20 and bus bar can be used side by side with the other components.

Another one of the features of the present invention is in regard to the interlocking and keying nature of the interlock connection sections 25, 64, 66 and 110. As noted above, the projections 68 and 70 have different lateral lengths. Likewise, the recesses 32, 34 have different lateral lengths. Thus, when the housing pieces 18, 20 and 22 are connected to each other even if the housing pieces are not precisely flush against each other the overlapping nature of the housing pieces prevent air gaps at the seams between the top side of the bottom sections and the bottom sides of the bottom sections. This prevents a possible incorrect air clearance and oversurface clearance between the bus bars and the member E. However, in alternate embodiments, any suitable type of overlapping of the housing pieces at their connection could be provided.

Figure 9:
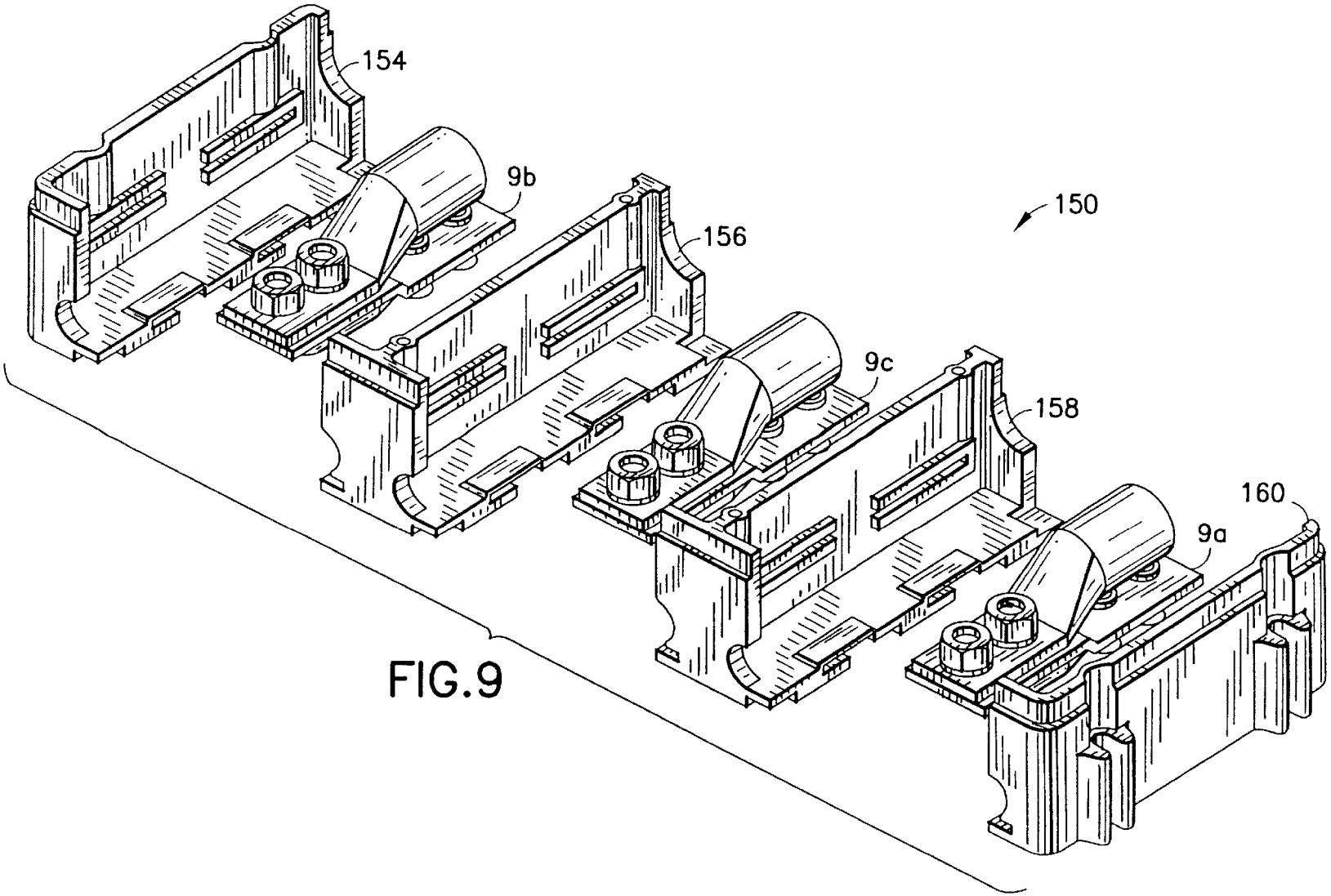
FIG. 9 is an exploded perspective view of an alternate embodiment of the present invention.

Another feature of the present invention is in regard to the modular design of the housing pieces 18, 20 and 22. The housing pieces are easily assembled without any special tools. The keying nature of the interlock connection sections 25, 64, 66 and 110 prevent the housing pieces from being incorrectly assembled relative to each other. Referring also to FIG. 9, an alternate embodiment of the electrical power connection block is shown. The embodiment shown is for a three poll connection. Thus, the connection block 150 comprises three electrical bus bars 9*a*, 9*b* and 9*c*, and connection block housing 152.

In this embodiment, the connection block housing 152 generally comprises a first housing piece 154, a second housing piece 156, a third housing piece 158 and a fourth housing piece 160. The first housing piece 154 is identical to the first housing piece 18 of the embodiment shown in FIGS. 1–7. The fourth housing piece 160 is identical to the third housing piece 22 of the embodiment shown in FIGS. 1–7. The second housing piece 156 and the third housing piece 158 are identical to each other. The second and third housing pieces 156, 158 are identical to the second housing piece 20 of the embodiment shown in FIGS. 1–7.

Thus, three housing piece components can be used to form a housing container for either a two pole situation, as in the embodiment shown in FIGS. 1–7, or a three poll situation as in the embodiment shown in FIG. 9. This can reduce manufacturing costs and inventory costs. For the three poll situation, a person assembling the housing components merely adds a second one of the middle housing pieces and an additional bus bar.

Referring now to FIGS. 12–18 an alternate embodiment of the electrical power connection block housing will be described. The electrical power connection block housing 200 is used to form an electrical power connection block assembly (see FIG. 14) comprising the electrical bus bars 9*a*, 9*b* and the electrical connectors 130*a*, 130*b*, 130*c*, 130*d*, 130*e*. However, in alternate embodiments, the assembly could comprise additional or alternative components. For example, any suitable type of bus bars or electrical connectors could be provided, such as the bus bars shown in FIGS. 10–11, for example. In addition, the assembly could be provided as a three poll configuration similar to that shown in FIG. 9.

The electrical power connection block housing 200 generally comprises a container 202 and a cover 204. The container 202 generally comprises three housing pieces 206, 208, 210. The three housing pieces 206, 208, 210 are substantially the same as the three housing pieces 18, 20, 22 shown in FIGS. 1–7 except for the differences noted below. The three housing pieces form two electrical connector receiving areas. Each connector receiving area has end apertures through opposite ends of the container at joints between the housing pieces. Two of the end apertures in a first end of the container have top sides which are open at a top open side of the container. The top sides of these two end apertures are closed by portions of the cover 204. Similar to the embodiment shown in FIGS. 1–7, each bus bars 9*a*, 9*b* is sandwiched between two of the housing pieces, each of the two housing pieces comprising slots which receive opposite lateral sides of the bus bars. However, in alternate embodiments, any suitable means for mounting the bus bars in the housing could be provided.

The projections 212 of the first interlock connection section 214 of the first housing piece 206 comprises a leading edge with a non-vertical angled surface 216. The recesses 218 of the second interlock connection section 220 of the second housing piece 208 comprises a non-vertical angled surface 222 which is located opposite the angled surface 216. The projections 224 of the third interlock connection section 226 of the second housing piece 208 comprise a leading edge with a non-vertical angled surface 228. The recesses 230 of the fourth interlock connection section 232 of the third housing piece 210 comprises a non-vertical angled surface 234 which is located opposite the angled surface 228.

Figure 18:
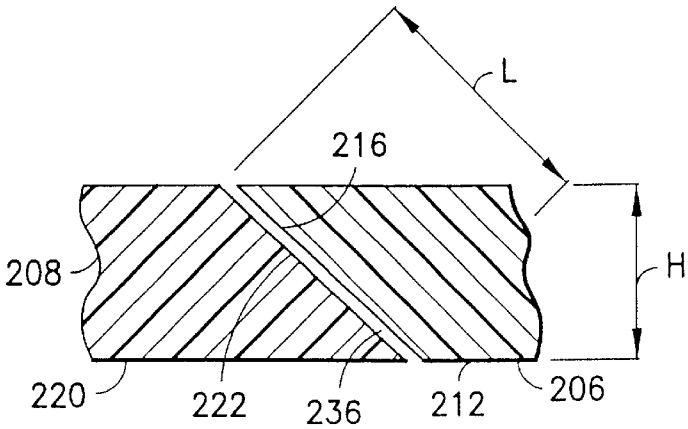
FIG. 18 is an enlarged partial cross sectional view of a projection and recess joint between two of the housing pieces shown in FIG. 17.

Referring particularly to FIG. 18, an enlarged cross sectional view of the surfaces 216, 222 is shown when the housing pieces are assembled to each other. A same view would be seen with regard to the surfaces 228 and 234. The surfaces 216, 222 are adapted to mate with each other at a joint 236. However, it is possible that the surfaces 216, 222 might not contact each other along the entire length of the connection between the housing pieces. Thus, an air gap may exist between the surfaces 216, 222 at the joint 236. Because the surfaces 216, 222 are angled, the length L of the joint 236 is longer than the height H of the joint 236. The increased distance or length of the joint 236 provides an increased resistance to passage of electricity through the joint 236 to the mounting member which the assembly is subsequently mounted to. This increased resistance to passage of electricity is created by an increased length air clearance between the electrical components inside the housing 200 and members located outside the housing. Minimizing the height H of the joint 236 also enables the overall height of the housing 200 to be minimized. Thus, the housing 200 can have a lower profile which is beneficial if the housing 200 is located in an enclosure to allow cables inside the enclosure to be located over the top of the cover 204. It is a desirable feature of the present invention to minimize the overall size of the connector block assembly. In alternate embodiments, the surfaces 216, 222 and the surfaces 228, 234 could comprise any suitable type of shape to increase the length or distance through the projection and recess joints between the top sides and bottom sides of the interlock connection sections.

The container 202 also comprises an additional conductor pass-through aperture 238. The aperture 238 is formed at the end joint of the mating first and second housing pieces 206, 208. Thus, the first electrical connector receiving area formed by the first and second housing pieces 206, 208 comprises three conductor pass-through apertures 238, 240, 242; two of the pass-through apertures 238, 240 (on the return side) extending through the same end wall. The third aperture 238 into the first electrical connector receiving area allows a bonding conductor (not shown) to pass through the housing 200 and be connected to the bus bar 9*a*. The second electrical connector receiving area formed by the second and third housing pieces 208, 210 comprises two conductor pass-through apertures 244, 246.

Figure 15:
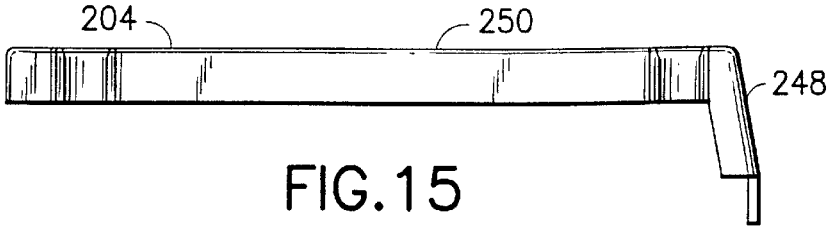
FIG. 15 is a side elevational view of the cover of the electrical power connection block shown in FIG. 14.
Figure 16:
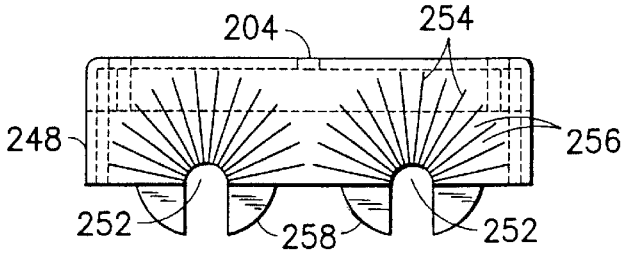
FIG. 16 is an end elevational view of the cover shown in FIG. 15.
Figure 17:
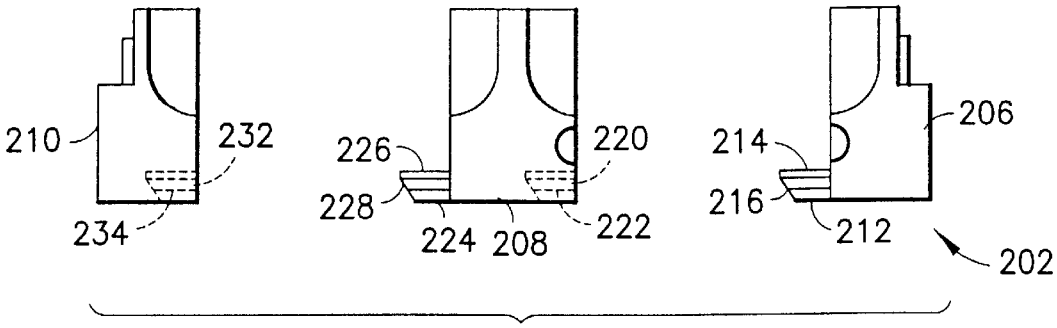
FIG. 17 is an exploded end elevational view of the container housing pieces shown in FIG. 14.

Referring particularly to FIGS. 15 and 16, the cover 204 comprises a downwardly extending end side 248. In the embodiment shown, the end side 248 is angled at an acute angle relative to a main section 250 of the cover 204. In a preferred embodiment, the end side 248 is angled relative to the main section 250 at an angle of about 80 degrees. However, in alternate embodiments, any suitable angle could be provided. In another alternate embodiment, the side end 248 could be curved. The end side 248 comprises two conductor pass-through apertures 252. The apertures 252 are aligned with the conductor pass-through apertures formed at the top open end of the container 202. This alignment forms the apertures 240, 244. The end side 248 comprises slits 254 extending outward from the apertures 252. In the embodiment shown, the slits 254 are arranged in a general semi-circular pattern. However, in alternate embodiments, any suitable pattern could be provided. The slits 254 are angled relative to each other at an angle of about 12 degrees. However, in alternate embodiments, any suitable angle could be provided.

The slits form cantilevered deflectable fingers 256 in the end side 248 which extend up to the apertures 252. The end side 248 also comprises projections 258 which extend into the conductor pass-through apertures formed at the top open end of the container 202. However, the projections 258 might not be provided. Alternatively, any suitable type or shape of projections could be provided. In another alternate embodiment, any suitable means for closing a gap between the housing 200 and conductors passing through apertures into the housing could be provided.

The use of the cover 204 allows the housing 200 to be used with relatively small conductors passing through the apertures 240, 244 with a greatly reduced risk that a user could accidentally insert a finger through one of the apertures 240, 244 and accidentally touch one of the bus bars 9 or connectors 130. The angle of the end side 248 insurers that when the cover 204 is connected to the container 202, the fingers 256 will all deflect outward in a same direction. This insures predictability to movement of the fingers 256 and insurers a minimal gap between the fingers. If the end side 248 was not angled at an acute angle, the fingers 256 might deflect in opposite directions. The angle of the end side, thus, promotes proper behavior of the deflection of the fingers in an outward direction.

Figure 14:
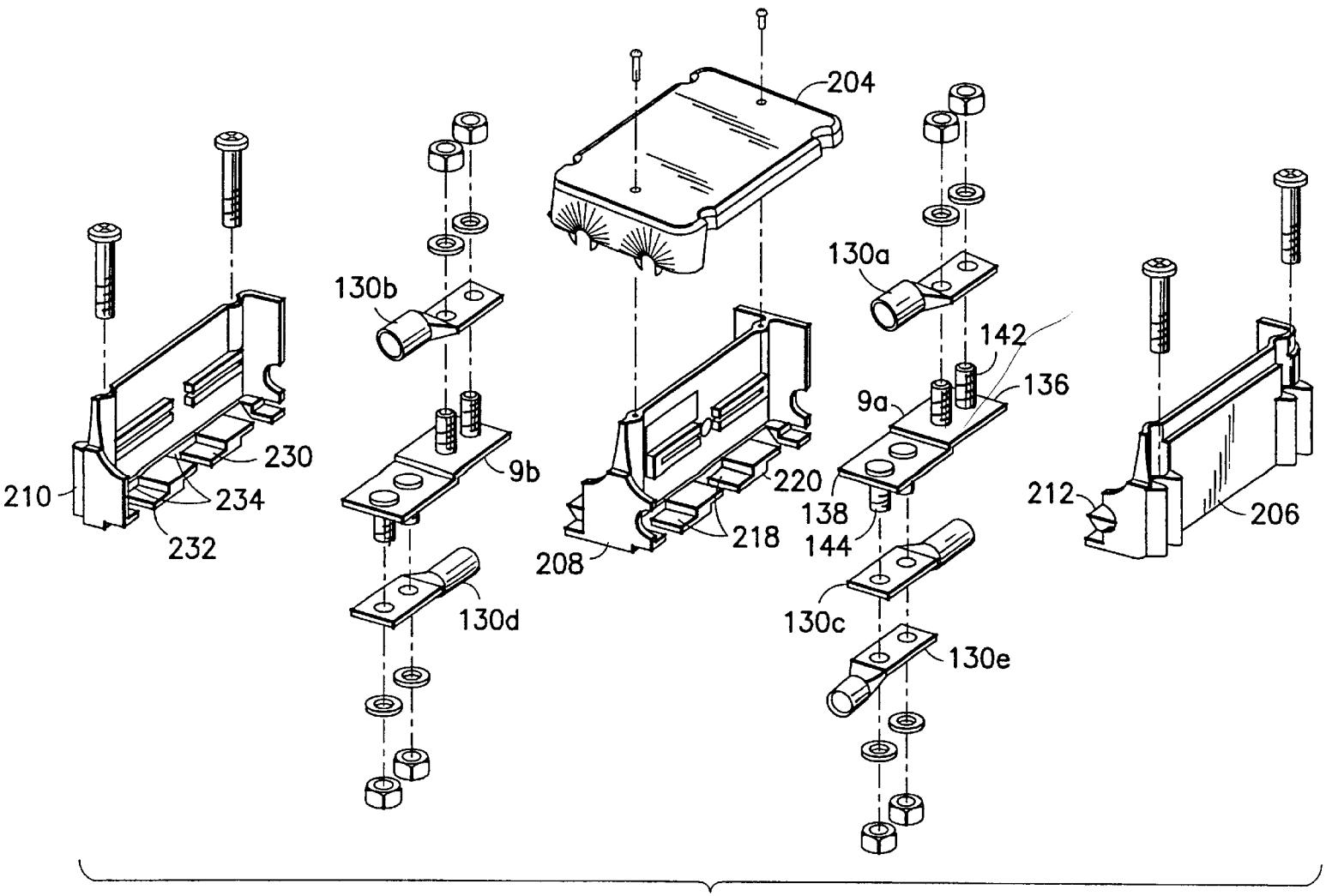
FIG. 14 is an exploded perspective view of an electrical power connection block assembly comprising the electrical power connection block housing shown in FIGS. 12 and 13.

Referring particularly to FIG. 14, the bus bar 9*b* and electrical connectors 130*b*, 130*d* on the battery side of the assembly is substantially the same as the embodiment shown in FIGS. 1–7. However, the return side of the assembly comprises an additional electrical connector 130*e*. The first connector 130*a* is connected to the mounting posts 142 of the first connection section 136 as in the first embodiment. However, the third connector 130*c* and a fifth connector 130*e* are both connected to the mounting posts 144 of the second connection section 138. The third and fifth connectors 130*c*, 130*e* are stacked with each other and fixedly mounted to the mounting posts 144. The fifth connector 130*e* extends in an opposite direction from the third connector 130*c*. The fifth connector 130*e* extends in a same direction as the first connector 130*a*. However, the fifth connector 130*e* is vertically offset from the first connector 130*a* because the two connectors are mounted to opposite sides of the bus bar 9*a*. The conductors which are connected to the first connector 130*a* and the fifth connector 130*e* can extend out of the same connector receiving area at a same end of the housing 200 through the two apertures 240, 238.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical power connection block assembly comprising:

an electrical power connection block housing comprising:

a container comprising multiple housing pieces connected to form at least two electrical connector receiving areas, each connector receiving area having end apertures through opposite ends of the container at joints between the housing pieces; and a cover connected to the container, wherein a first one of the connector receiving areas comprises two of the end apertures in a first one of the opposite ends and one of the end apertures in a second one of the opposite ends;

an electrical bus bar sandwiched between two of the housing pieces, each of the two housing pieces comprising slots which receive opposite lateral sides of the bus bar, wherein the electrical bus bar comprises a first section with at least one first fastening post extending in a first direction and a second section with at least one second fastening post extending in an opposite second direction;

a first electrical connector connected to the first section and extending towards the first opposite end of the container;

a second electrical connector connected to the second section and extending towards a second one of the opposite ends of the container; and a third electrical connector connected to the second section and extending towards the first opposite end of the container.

2. An electrical power connection block assembly as in claim 1 wherein the second and third electrical connectors are both mounted on the second fastening post.

3. An electrical power connection block housing comprising:

a container comprising multiple housing pieces connected to form at least two connector receiving areas, the container having a first conductor pass-through aperture in an end wall open to a top open side of the container; and a cover connected to the top side of the container, the cover having a downwardly extending end side with a second conductor pass-through aperture aligned with the first conductor pass-through aperture, the end side of the cover having slits extending outward from the second conductor pass-through aperture forming cantilevered deflectable fingers extending up to the second conductor pass-through aperture, wherein a first one of the housing pieces comprises a first interlock connection section and a second one of the housing pieces comprises a first side with a second interlock connection section directly interconnected with the first interlock connection section, wherein the first and second interlock connection sections comprise a mating projection and recess, and wherein a leading edge of the projection comprises an angled surface located opposite an angled surface in the recess such that a distance along a projection and recess joint between the angled surfaces is longer than a height of the projection and recess joint.

* * * * *